United States Patent [19]

Eguchi

[11] 4,321,306

[45] Mar. 23, 1982

[54] RUBBER STOPPER FOR TIGHT SEALING

[76] Inventor: Tsukasa Eguchi, 2-9-506 Akabanedai 1-chome, Kita-ku, Tokyo 115, Japan

[21] Appl. No.: 201,388

[22] PCT Filed: Nov. 15, 1979

[86] PCT No.: PCT/JP79/00293

§ 371 Date: Jul. 10, 1980

§ 102(e) Date: Jul. 10, 1980

[87] PCT Pub. No.: WO80/01060

PCT Pub. Date: May 29, 1980

[30] Foreign Application Priority Data

Nov. 17, 1978 [JP] Japan ..... 53-142484

[51] Int. Cl.[3] ..... B32B 27/30; B65D 39/00

[52] U.S. Cl. ..... 428/421; 215/364; 220/307; 220/DIG. 19; 428/422; 428/492; 428/521

[58] Field of Search ..... 428/492, 422, 421, 517, 428/521; 215/364, 365; 220/307, DIG. 19

[56] References Cited

U.S. PATENT DOCUMENTS

| | | | |
|---|---|---|---|
| 3,578,037 | 5/1971 | Flynn | 215/364 |
| 3,628,681 | 12/1971 | Schwartz | 215/48 |
| 3,760,969 | 9/1973 | Shimatmoto | 215/37 R |
| 4,151,342 | 4/1979 | Uchino | 428/500 |

FOREIGN PATENT DOCUMENTS

| | | |
|---|---|---|
| 14-7343 | 5/1939 | Japan . |
| 14-9959 | 6/1939 | Japan . |
| 45-17831 | 7/1970 | Japan . |
| 51-24383 | 2/1976 | Japan . |
| 52-1355 | 1/1977 | Japan . |

*Primary Examiner*—Ellis P. Robinson
*Attorney, Agent, or Firm*—Fred Philpitt

[57] ABSTRACT

To eliminate contamination of foreign matters deposited on the surface for a rubber stopper for tight sealing for medical purpose as for tight sealing of a medical injection liquid bottle, a vulcanized film of propylene-tetrafluoroethylene-glycidyl vinyl ether copolymer rubber is coated partially or wholly onto the surface of the rubber stopper. Vulcanization of the copolymer rubber can be carried out only by heating in the absence of a vulcanizing agent, and a vulcanized film with a good adhesiveness to the rubber stopper and a good sliding characteristic can be formed thereon.

9 Claims, 4 Drawing Figures

20 μm

50 μm

20 μm

50 μm

RUBBER STOPPER FOR TIGHT SEALING

TECHNICAL FIELD

The present invention relates to a rubber stopper for tight sealing. More particularly, the invention relates to a rubber stopper for tight sealing wherein the surface of the rubber stopper is partly or wholly coated with a vulcanized film of specific fluorine rubber.

BACKGROUND ART

The presence of foreign matters attaching to a rubber stopper for tight sealing, particularly a rubber stopper for medicament, such as for tight sealing a bottle for a medical injection liquid, is a recent, serious problem. The foreign matters include those which are retained on the rubber stopper even after washing, or those which are caused through contact of the rubber stopper with a medical liquid, and causes for their generation differ one from another. Specifically, when the surface of washed rubber stopper is observed by a scanning electron microscope at magnification of about $10^2$–$10^3$ times, the presence of indented locations or attachment of solid foreign matters can be observed thereon. It seems that they are connected to an increase in the number of foreign matters with time. A vulcanization accelerator, carbon black, zinc oxide, titanium oxide, sulfur, etc. are added to rubber, and it is inevitable to exude or elute these various additives or fillers to the surface of rubber stopper at the sterilization treatment of rubber stopper or at the contact with a medical liquid. Therefore, contamination of foreign matters cannot be eliminated by plugging an opening of a bottle for medical injection liquid with a rubber stopper and then conducting sterilization treatment thereof by hot water or steam, or by an ethylene oxide gas, while disregarding such a presence of foreign matters, though elimination of bacterial contamination can be attained. Thus, the essential solution of the problem has not been attained yet.

Furthermore, rubber material constituting the rubber stopper generally has a high coefficient of friction, which not only makes it more difficult to eliminate the bacteria or foreign matters from the surface of rubber stopper, but also makes rubber stoppers having readily adhesible surfaces readily adhesible to one another, and thus frequent generation of troubles is inevitable at the plugging operation. Chlorinated butyl rubber so far used as a rubber stopper material for vial bottles on account of excellence in gas impermeability, steam impermeability, anti-aging property, high and low temperature characteristics, etc. is a chlorination product of butyl rubber made by copolymerization of isobutylene as a major component with a small amount of isoprene, and thus a fear of occurrence of chemical reaction on the surface of rubber stopper is expected at the sterilization treatment by ethylene oxide gas.

To solve various problems encountered in such rubber stopper for tight sealing, particularly rubber stopper for medicament, such as for tight sealing a bottle for medical injection liquid, it has been proposed to coat the surface of rubber stopper with a film of specific synthetic resin or a vulcanized film of synthetic rubber. The film of synthetic resin can be formed by pasting a film of synthetic resin to an adhesive-coated surface of rubber stopper or integrally molding a film of synthetic resin on the surface part of rubber stopper, or the like, but these procedures are generally not only complicated in operation, but also are not applicable on account of shape of some rubber stopper. Furthermore, the film is often peeled off during the use on account of the insufficient adhesion strength. As the vulcanized film of synthetic rubber, a vulcanized film of fluorine rubber having a remarkable excellence in the chemical resistance and sliding characteristics can be contemplated, but the fluorine rubber itself has been so far used only as a parting agent, and thus its adhesiveness to various substrates including rubber is never satisfactory. For example, it is well known that the adhesiveness of vinylidene fluoride- hexafluoropropylene copolymer rubber, which is deemed to be typical fluorine rubber, to various substrates can be assured satisfactorily only by application of a primer or an adhesive.

DISCLOSURE OF INVENTION

As a result of various studies of materials capable of forming a coating film having a self-adhesiveness to rubber stopper materials at first, less susceptible to attachment of bacteria or foreign matters, and chemically and physically stable to various sterilization treatments, the present inventor has found that propylene-tetrafluoroethylene-glycidyl vinyl ether copolymer rubber can fully satisfy the aforementioned requirements. That is, the propylene-tetrafluoroethylene-glycidyl vinyl ether copolymer rubber is a fluorine-containing elastomer having excellence in heat resistance, chemical resistance, cold resistance, etc., and can form a good vulcanized film on the surface of rubber stopper and furthermore can substantially completely eliminate the contamination of foreign matters from the surface of rubber stopper. Furthermore, such specific, vulcanized film has a lubricating property, and the problem of mutual adhesion of rubber stoppers can be effectively solved.

Thus, the present invention relates to a rubber stopper for tight sealing, which comprises coating a vulcanized (cross-linked) film of propylene-tetrafluoroethylene-glycidyl vinyl ether copolymer rubber partly or wholly onto the surface part of the rubber stopper.

An object of the present invention thus constructed is to form a vulcanized film of fluorine rubber having a specific self-adhesiveness on the surface of a rubber stopper. Another object of the present invention is to provide a rubber stopper for tight sealing, which has a good sliding characteristics and thus a less susceptibility to attachment of bacteria or foreign matters. Further object is to provide a rubber stopper for tight sealing which is capable undergoing smooth plugging operation, etc. and causing no troubles such as mutual adhesion, etc. during the transportation, reservation, etc. on account of a good non-adhesiveness. Still further object of the present invention is to provide a rubber stopper for tight sealing, coated with a vulcanized film chemically and physically stable to various sterilization treatments. Furthermore, other object of the present invention is to provide a rubber stopper for tight sealing, where elution of foreign matters and dropping off, etc. of the fine particles not only from the rubber stopper itself, but also from the vulcanized film coating its surface are suppressed to minimum. Still other object is to provide a rubber stopper for tight sealing, which is coated with a vulcanized film formed by heat vulcanization in the absence of a vulcanizing agent.

The propylene-tetrafluoroethylene-glycidyl vinyl ether copolymer rubber constituting the vulcanized film has a comonomer composition of 40–50% by mole, preferably 42–47% by mole, of propylene, 50–60% by mole, preferably 53–58% by mole, of tetrafluoroethylene, and 0.01–10% by mole, preferably 0.2–5% by mole, of glycidyl vinyl ether, as disclosed in Japanese Laid-Open Patent Application Ser. No. 75290/53, and so long as the essential characteristics of the copolymer may not be deteriorated, a fourth component, such as other comonomers, for example, ethylene, isobutylene, vinyl fluoride, vinylidene fluoride, hexafluoropropylene, alkyl vinyl ether, chlorotrifluoroethylene, etc. can be copolymerized in a small amount, for example, at a ratio of less than about 15% by mole. Preferable number average molecular weight of the copolymer rubber is in a range of about 20,000–100,000, particularly about 30,000–80,000, in view of the film formability, vulcanizate physical properties, etc.

The vulcanization of copolymer rubber of propylene-tetrafluoroethylene-glycidyl vinyl ether can be carried out by various vulcanization cross-linking procedures, for example, by chemical cross-linking with organic peroxides or amines, or by radiation cross-linking by irradiation of ionizing radiation rays such as α rays and electron beams, particularly because of the excellent vulcanization characteristics.

One feature in the vulcanization of the copolymer rubber is such a fact that vulcanization can be carried out even at a relative low temperature such as approximately room temperature in the case of a vulcanizable composition containing a specific vulcanizing agent. As the specific vulcanizing agent, tertiary amines or their salt, or combination of these tertiary amines with hydroxy group-containing compounds can be used, as disclosed in said Japanese Laid-open Patent Application Ser. No. 75290/53. As the tertiary amines, for example, benzyldimethylamine, α-methylbenzyldimethylamine, dimethylaminomethylphenol, tris-(dimethylaminomethyl)phenol, diethylaminopropylamine, N-aminoethylpiperazine, methylimidazole, triethylenediamine, N,N'-bisalkylenepiperazine, 4,4'-trimethylenedipiperadine, N-ethylmorpholine, 1,8-diaza-bicyclo(5,4,0)undecene-7 and their hydroacid salts. As the hydroxy group-containing compounds to be used in combination with these tertiary amines, octanol, cyclohexanol, ethyleneglycol, propyleneglycol, polyethyleneglycol, polypropyleneglycol, hydroquinone, catechol, resorcinol, 2,2'-bis-(4-hydroxyphenyl)propane [so-called bisphenol A], 1,3,5-trihydroxybenzene, dihydroxynaphthalene, 4,4'-dihydroxydiphenyl, 4,4'-dihydroxystilbene, 2,2'-bis(4-hydroxyphenyl)butane [so-called bisphenol D], 2,4-dihydroxybenzophenone, 2,4-dihydroxybenzoic acid, 4,4'-dihydroxydiphenylsulfone, 2-methylresorcinol, trimethylallyloxyphenol, tris(4-hydroxyphenyl)methane, etc. can be mentioned.

Furthermore, aromatic polyamines or their salts, for example, xylylenediamine, metaphenylenediamine, diaminodiphenylmethane, diaminodiphenylsulfone, or alicyclic or heterocyclic polyamines, for example, menthanediamine, bisaminopropyltetraoxaspiroundecene, etc. can be likewise used as the room temperature-vulcanizable vulcanizing agent, though the chemical stability of cross-linking bonds is somewhat inferior to that of the former vulcanizing agent.

These vulcanizing agents are used at a ratio of 0.1–10 parts by weight to 100 parts by weight of the copolymer rubber. Vulcanization is carried out at a temperature of room temperature-about 250° C. Typical composition of room temperature-vulcanizable composition is given below.

| | |
|---|---|
| Copolymer rubber | 100 parts by weight |
| MT carbon black | 0–60 parts by weight |
| Hydroquinone | 0.2–2 parts by weight |
| Tris(dimethylaminomethyl)phenol | 0.2–2 parts by weight |

Such a vulcanizable compound is kneaded, for example, by mixing rolls, open rolls, etc., then shaped into a sheet form having a thickness of about 0.5–1 mm, cut to an appropriate size, and dissolved in a solvent, thereby preparing a solution. As the solvent, mainly any of ethyl acetate, tetrahydrofuran, 1,1,2-trichlorotrifluoroethane, etc. is used at a ratio of about 150 parts by weight or more, generally about 150–230 parts by weight, to 100 parts by weight of the vulcanizable compound. Butyl acetate, isoamyl acetate, etc. can be added as a viscosity regulator to these solvents, and, for example, in the case of a mixed solvent of ethyl acetate- butyl acetate, it can be used at a mixing ratio between 100/100 and 200/100.

The solution of vulcanizable compound thus formed has a polymer concentration of less than about 40% by weight, preferably about 20–2% by weight, and a viscosity of less than about 1000 centipoises, preferably 250–100 centipoises (25° C.). Application of the solution to the surface of rubber stopper is carried out preferably, in the case of partial application to surface parts, by brush painting, spray painting, etc., and, in the case of application to the whole surface, by dipping. The amount of the solution to be applied can be less than about 1μ in the terms of the thickness of vulcanizable film, but generally about 1–100μ, preferably about 2–10μ. The vulcanizable compound can be applied to the surface of rubber stopper by powder painting without forming the solvent solution.

The vulcanizable compound containing the vulcanizing agent is vulcanized by heating generally at a temperature of about 80°–250° C. For example, in the case of the aforementioned typical vulcanizable compound containing 35 parts by weight of MT carbon black, a film (5μ thick) having the following physical properties can be formed by vulcanization by heating at 150° C. for 30 minutes:

| | |
|---|---|
| Tensile strength | 125kg/cm$^2$ |
| Elongation at break | 200% |
| 100% modulus | 71kg/cm$^2$ |
| Hardness (Shore A) | 76 |

Vulcanizable compound containing the aforementioned specific vulcanizing agent can be vulcanized even at room temperature, which is a great feature of the copolymer rubber, as described before. Vulcanization can be carried out only by leaving the compound at room temperature for about 3–14 days, whereby a strongly bonded vulcanized film having a tensile strength of 100 kg/cm$^2$ or more can be formed.

The inventor has found that vulcanization of the propylene-tetrafluoroethylene-glycidyl vinyl ether copolymer to be used in the present invention can be carried out only by heating at about 130°–200° C., preferably about 140°–160° C., for 5–30 minutes, preferably about 10–20 minutes, without using any vulcanizing agent, which can be regarded as a remarkable feature of the copolymer rubber. This means that, when the rubber stopper is used for a medical purpose, such as for tight sealing a bottle for medical injection liquid, etc., such disadvantages as side effects, etc., which may be brought about by the presence of a vulcanizing agent, can be avoided, and that the sanitary effect and safety in handling of medicaments can be more assured. Application of the vulcanizable compound containing no vulcanizing agent to the surface of rubber stopper can be carried out in the same manner as in the case of vulcanizable compound containing a vulcanizing agent.

The vulcanizable compound containing a vulcanizing agent or not can be further contain various additives usually used, if necessary, for example, such a metal oxide such as magnesium oxide and zinc oxide, such a reinforcing agent such as carbon black and fine silica, a filler, a pigment, an antioxidant, a stabilizer, etc. Furthermore, other synthetic rubber, natural rubber, or furthermore synthetic resin, etc. can be also added thereto, so long as they may not deteriorate the characteristics of the propylene-tetrafluoroethylene-glycidyl vinyl ether copolymer rubber. Compounding of the vulcanizable compound is carried out by rolls for rubber kneading, banbury mixer, etc. so far used.

It is pointed out that vulcanized film of the propylene-tetrafluoroethylene-glycidyl vinyl ether copolymer rubber coated partially or wholly on the surface part of rubber stopper has a high adhesiveness to the rubber stopper material itself, different from the vulcanized films of other fluorine rubber. Therefore, when such a vulcanized film is coated on the surface of rubber stopper for a vial bottle made from chlorinated butyl rubber having particular excellence in gas impermeability and steam impermeability, not only sterilization treatment by ethylene oxide gas can be effectively carried out on account of a good chemical resistance of the vulcanized film, but also sterilization treatment by boiling water or steam can be carried out because the adhesiveness is not lost even in hot water.

Furthermore, the vulcanized film has an excellent surface sliding characteristics, and thus such a disadvantage of impeding smooth plugging operation by adhesion of the rubber stopper surfaces themselves to one another is not brought about, and such a characteristic as less susceptibility to attachment of bacteria or foreign matters is obtained. Thus, the vulcanized film coated on the surface of rubber stopper is less susceptible to attachment of bacteria or foreign matters, and even if bacteria happen to deposit thereon, the sterilization treatment can be also effectively carried out. Thus, in combination of the fact that the vulcanized film can be formed without using any vulcanizing agent, the sanitory effect and safety required for medical rubber stopper can be satisfactorily assured.

In this manner, the propylene-tetrafluoroethylene-glycidyl vinyl ether copolymer rubber has a feature that the vulcanizability and the adhesiveness are considerably improved without impairing the chemical resistance, heat resistance, sliding characteristic, etc. as the characteristics generally possessed by fluorine rubber. Therefore, in the case a rubber stopper particularly requiring such properties as gas impermeability, steam impermeability, etc., a specific rubber material such as butyl rubber, chlorinated butyl rubber, a mixture of chlorinated butyl rubber and polybutadiene, etc. must be used, but in other cases than the above, by coating such a vulcanized film onto the surface of a rubber stopper, natural rubber, and various synthetic rubbers such as butadiene rubber, nitrile rubber, styrene-butadiene rubber, chloroprene rubber, epichlorohydrin rubber, ethylene-propylene rubber, ethylene-propylene-diene rubber, etc. can be used as a rubber material as desired. This can eliminate such a disadvantage so far encountered that a rubber material must be selected and used in accordance with the kind of an injection medicament in contact with a rubber stopper in view of a medical liquid resistance. That is, the difficulty and complicatedness in selecting a rubber material can be eliminated and also a possible risk of misapplication can be eliminated.

BEST MODE FOR CARRYING OUT THE INVENTION

Figure 1:
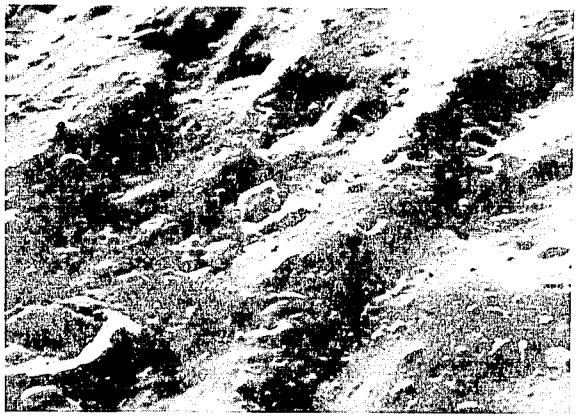
FIGS. 1 and 2 are scanning type electron microphotographes of the surface of rubber stopper for tight sealing, made from butyl rubber.
Figure 2:
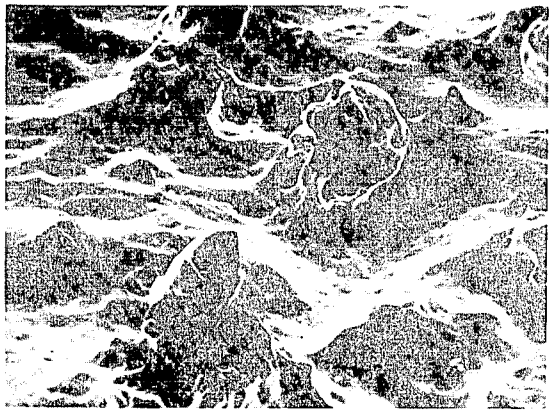
Figure 3:
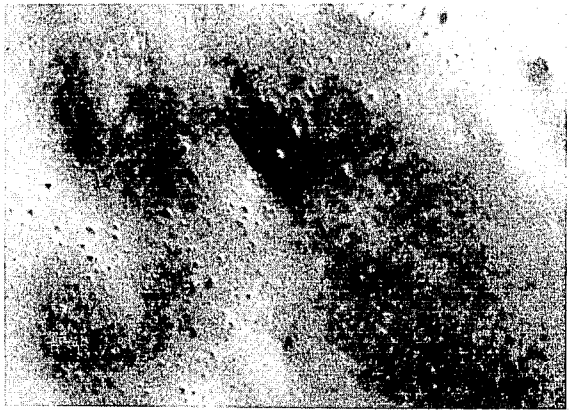
FIGS. 3 and 4 are scanning type electron microphotographes of vulcanized film of propylene-tetrafluoroethylene-glycidyl vinyl ether copolymer rubber provided on the surface of rubber stopper for tight sealing, made from butyl rubber, respectively.
Figure 4:
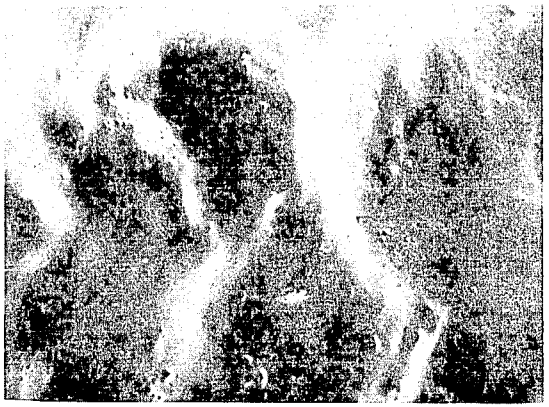

The effect of the present invention will be described, referring to Example.

EXAMPLE (Copolymer rubber A)

Propylene-tetrafluoroethylene-glycidyl vinyl ether (43:55:2% by mole) copolymer [Number average molecular weight 60,000] (Copolymer rubber B)

Propylene-tetrafluoroethylene-glycidyl vinyl ether (42:53:5% by mole) copolymer [Number average molecular weight 30,000]

The copolymer rubber A or B was dissolved in 1,1,2-trichlorotrifluoroethane containing a small amount of ethyl acetate to prepare a solution having a copolymer concentration of 5% by weight, respectively. A rubber stopper for a vial bottle, made from butyl rubber, which has a flat disk top, 20 mm in diameter, was immersed in the solution to form a coating film on the entire surface of the surface part of the rubber stopper. The film was dried, and heated at 150° C. for 30 Minutes, whereby the rubber stoppers A and B each coated with a vulcanized film having a thickness of 5$\mu$ were obtained.

To investigate the sliding characteristic of the vulcanized film thus formed, the rubber stopper for vial bottle was placed, with the top side down, on a polytetrafluoroethylene sheet coating on a phenol resin plate. When one end of the phenol resin plate was elevated from the horizontal position at a linear velocity of 8 mm/min., an angle at a moment at which the rubber stopper A or B started to slide down (an angle of repose) was measured. A value of 35° was obtained in both cases, which was evidently better than 50° of uncoated rubber stopper and 45° of silicone coating.

To test the adhesiveness at hot water boiling, the rubber stoppers A and B for vial bottle were immersed in hot water at 100° C. for 3 hours, but no peeling off of the vulcanized film was observed the both cases. On the other hand, a vulcanized film of fluorine rubber coating material (Perfuron paint; Trademark of a product made by Kinyo-sha) coated wholly on the surface of rubber stopper for vial bottle, made from butyl rubber was peeled off under the same test conditions.

Various kinds of toxicity were tested according to Notification No. 434, of the Ministry of Health and Welfare. Rubber stoppers A and B having the vulcanized coating film according to the present invention were satisfactory in all the test items, whereas a rubber stopper having a vulcanized film of the aforementioned fluorine rubber coating material was evaluated unsatisfactory in some test items.

As to the antibacterial effect, the vulcanized coating films of rubber stoppers A and B were tested according to Test MIL-E-5272 C containing 4 groups of usually occurring bacteria, but no formation of bacteria was observed within 30 days.

Furthermore, percent weight increase by hot water or steam treatment of rubber stoppers having a vulcanized film having a thickness of 10μ was measured. 4 rubber stoppers having a vulcanized film, each weighing 2.4 g, were exactly weighed, and immersed in pressured, heated water at 140° C. for 2 hours, are then dried in an atomosphere at 105° C. for 10 minutes. As a result, a percent weight increase of 0.27% was measured, which was as small as about 1/7 of 1.95%, the percent weight increase of the rubber stopper having no vulcanized film. Similar result was obtained even in the case of using heated steam at the same temperature in place of the heated water.

In addition to the above-mentioned sliding characteristic, peeling off resistance when immersed in hot water, toxicity test, antibacterial test, and percent weight increase by hot water or steam treatment, characteristics of the rubber stopper A was further tested in the following items. For comparison, measured values of rubber stoppers for vial bottles, made from butyl rubber, without a vulcanized film, are also given together. The result are shown in the following Table.

TABLE

| Item | Table Standard | Coated rubber stopper | Non-coated rubber stopper |
|---|---|---|---|
| [Elution product test] | | | |
| Property | 99.0% or more | 100–99.9 | 99.7 |
| pH | 1.0 or less | 0.2 | 0.5 |
| Ultraviolet absorption spectrum | 0.20 or less | 0.01–0.02 | 0.01–0.02 |
| $KMnO_4$-reducing substance | 2.0 or less | 0.5 | 0.5 |
| Penetration pressure | 800g or less | 400–430 | 410 |
| Number of peeled fragments | 5 or less | 0 | 0 |
| Distribution of fine particle numbers | 2–3μ | 23 | 25241 |
| | 3–5μ | 15 | 24836 |
| | 5–7μ | 8 | 8397 |
| | 7–10μ | 5 | 1773 |
| | 10–20μ | 3 | 755 |

Note 1
The elution product test was conducted according to the rubber stopper test procedure for transfusion set forth in the Japanese Pharmacopoeia, 9th revision. That is, a rubber stopper was washed with water, and then dried at room temperature. It was then placed in a glass vessel meeting the alkali elution test according to the glass ware test procedure for injecting material, water in an amount 10 times as large as the weight of the sample was added and sealed with an appropriate stopper. Then, it was heated at 121° C. for one hour in a high pressure steam sterilizer, and then left standing till room temperature. Then, the rubber stopper was removed therefrom immediately, and the resulting liquid was used as a test liquid. Separately, a blank test liquid was prepared from water in the same manner as above.
(Property) The test liquid was colorless and transparent, and transmission rates at a layer length of 10 cm and wave length of 430 nm and 650 nm were measured, using the blank test liquid as control, and were found to be more than 99.0%, respectively.
(pH) 20 ml each of the test liquid and blank test liquid were taken, and admixed each with 1.0 ml of a solution prepared by dissolving 1.0g of potassium chloride in water to make 100 ml, and pH of both solutions was measured. The differences were less than 1.0.
(Ultraviolet absorption spectrum) Absorbancy at a layer length of 10 mm and wave length of 220–350 nm of the test liquid and the blank test liquid as control was measured, and was found to be less than 0.20.
($KMnO_4$-reducing substance) 100 ml of the test liquid was placed in a conical flask with ground stopper, admixed with 10.0 ml of 0.01N $KMnO_4$ solution and 5 ml of dilute sulfuric acid, and boiled for 3 minutes. After cooling, 0.1g of potassium iodide was added thereto, and the flask was tightly sealed, shaked and left standing for 10 minutes, and then the liquid was titrated with a 0.01N sodium thiosulfate solution (indicator: 5 droplets of starch test solution). Separately, 100 ml of the blank test liquid was treated in consumption of 0.01N $KMnO_4$ solution was less than 2.0 ml.
Note 2
Penetration pressure was determined by twice stabbing a rubber stopper plugging in a vial bottle with an needle for intravenous injection ⅛ at a stabbing speed of 500 mm/min. and measuring a stabbing load at that time by Autograph-IS-2000, made by Shimazu Seisakusho.
Note 3
Number of peeled fragments was determined by stabbing a rubber stopper plugged in a vial bottle filled with distilled water for injection five times, filtering sucked liquid in the bottle by filter paper, drying the filter paper and observing the number of fragments peeled from the rubber stopper by a substantial microscope.
Note 4
Number of fine particles was determined by plugging a vial bottle filled with dust-free water with a rubber stopper, shaking the bottle for 5 minutes, and measuring the number of fine particles by HIAC-PC-320 type fine particle-measuring device.

I claim:

1. A rubber stopper for tight sealing having its surface at least partially coated with a vulcanized film of a propylene-tetrafluoroethylene-glycidyl vinyl ether copolymer rubber containing on a mole basis 40–50% propylene, 50–60% tetrafluoroethylene and 0.01–10% of glycidyl vinyl ether.

2. A rubber stopper for tight sealing according to claim 1, wherein the propylene-tetrafluoroethylene-glycidyl vinyl ether copolymer rubber has a comonomer composition consisting of 42–47% by mole of propylene, 53–58% by mole of tetrafluoroethylene and 0.2–5% by mole of glycidyl vinyl ether.

3. A rubber stopper for tight sealing according to claim 1, wherein propylene-tetrafluoroethylene-glycidyl vinyl ether copolymer copolymerized with at least one of fourth comonomers selected from the group consisting of ethylene, isobutylene, vinyl fluoride, vinylidene fluoride, hexafluoropropylene, alkyl vinyl ether and chlorotrifluoroethylene in a proportion of less than about 15% by mole is used.

4. A rubber stopper for tight sealing according to claim 1, wherein the vulcanized film is formed by vulcanization in the presence of a vulcanizing agent.

5. A rubber stopper for tight sealing according to claim 4, wherein the vulcanized film is formed at room temperature or at an elevated temperature of above room temperature to not more than 250° C.

6. A rubber stopper for tight sealing according to claim 1, wherein the vulcanized film is formed by vulcanization by heating in the absence of a vulcanizing agent.

7. A rubber stopper for tight sealing according to claim 6, wherein the vulcanized film is formed by heating at a temperature of about 130°–200° C.

8. A rubber stopper for tight sealing according to claim 1, wherein the rubber stopper is shaped from a rubber material selected from the group consisting of butyl rubber, chlorinated butyl rubber and a mixture of chlorinated butyl rubber and polybutadiene.

9. A rubber stopper for tight sealing according to claim 1, wherein the rubber stopper for tight sealing is a rubber stopper for medical purpose.

* * * * *